US009309825B2

(12) United States Patent
Roth et al.

(10) Patent No.: US 9,309,825 B2
(45) Date of Patent: Apr. 12, 2016

(54) METHOD AND DEVICE FOR ADAPTING ADAPTATION VALUES FOR THE CONTROL OF INJECTORS IN AN ENGINE SYSTEM HAVING MULTIPLE INJECTION TYPES

(75) Inventors: Andreas Roth, Muehlacker-Lomersheim (DE); Alexander Schenck Zu Schweinsberg, Moeglingen (DE); Kai Jakobs, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 712 days.

(21) Appl. No.: 13/636,759

(22) PCT Filed: Mar. 15, 2011

(86) PCT No.: PCT/EP2011/053888

§ 371 (c)(1),
(2), (4) Date: Dec. 3, 2012

(87) PCT Pub. No.: WO2011/117114

PCT Pub. Date: Sep. 29, 2011

(65) Prior Publication Data

US 2013/0096802 A1 Apr. 18, 2013

(30) Foreign Application Priority Data

Mar. 24, 2010 (DE) ..... 10 2010 003 209

(51) Int. Cl.
*F01L 1/34* (2006.01)
*F02D 41/26* (2006.01)
(Continued)

(52) U.S. Cl.
CPC ..... *F02D 41/26* (2013.01); *F02D 41/2467* (2013.01); *F02D 41/3094* (2013.01); *F02M 63/02* (2013.01); *F02M 69/046* (2013.01); *F02M 69/462* (2013.01)

(58) Field of Classification Search
CPC ..... Y02T 10/44; F02D 41/40; F02D 41/3094; F02D 41/0025; F02D 41/0255; F02D 2200/0606; F02D 2200/0608; F02D 19/0689; F02D 2041/001; F02D 41/402; F02M 69/462
USPC ..... 701/103, 104; 123/308, 432, 299, 300, 123/304, 575–578
See application file for complete search history.

(56) References Cited

U.S. PATENT DOCUMENTS

2003/0127072 A1* 7/2003 Gmelin et al. ..... 123/431
2006/0102149 A1* 5/2006 Furusawa et al. ..... 123/446
(Continued)

FOREIGN PATENT DOCUMENTS

CN 101365871 2/2009
JP 64-29651 1/1989
(Continued)

OTHER PUBLICATIONS

International Search Report, PCT International Application No. PCT/EP2011/053888, dated May 17, 2011.

*Primary Examiner* — Hai Huynh
*Assistant Examiner* — Gonzalo Laguarda
(74) *Attorney, Agent, or Firm* — Kenyon & Kenyon LLP

(57) ABSTRACT

A method for adapting the adaptation values for the adaptation of fuel injection quantities of an internal combustion engine, to which fuel is supplyable via a mixed operation of two injection types, a first adaptation value for adapting a first injection quantity specification according to which the internal combustion engine is operated by a first injection type, and a second adaptation value for adapting a second injection quantity specification according to which the internal combustion engine is operated by a second injection type, the adaptation values being each adapted in defined, not overlapping adaptation ranges as a function of the operating state, at least one of the adaptation ranges including operating states in which fuel is supplied to the internal combustion engine via both injection types.

21 Claims, 4 Drawing Sheets

(51) Int. Cl.

| | |
|---|---|
| ***F02D 41/24*** | (2006.01) |
| ***F02D 41/30*** | (2006.01) |
| ***F02M 63/02*** | (2006.01) |
| *F02M 69/46* | (2006.01) |
| *F02M 69/04* | (2006.01) |

(56) References Cited

U.S. PATENT DOCUMENTS

| | | | | |
|---|---|---|---|---|
| 2006/0107650 | A1* | 5/2006 | Tokuda | 60/284 |
| 2006/0207562 | A1* | 9/2006 | Miyazaki et al. | 123/431 |
| 2009/0299611 | A1 | 12/2009 | Yamashita et al. | |
| 2010/0161203 | A1* | 6/2010 | Shigenaga | F02D 13/0215 701/110 |
| 2014/0158086 | A1* | 6/2014 | Matsuda et al. | 123/294 |

FOREIGN PATENT DOCUMENTS

| | | |
|---|---|---|
| JP | 3 185 242 | 8/1991 |
| JP | 2005 048 730 | 2/2005 |
| JP | 2005 214 015 | 8/2005 |
| JP | 2006-138249 | 6/2006 |
| WO | WO 2007 099425 | 9/2007 |

* cited by examiner

METHOD AND DEVICE FOR ADAPTING ADAPTATION VALUES FOR THE CONTROL OF INJECTORS IN AN ENGINE SYSTEM HAVING MULTIPLE INJECTION TYPES

FIELD OF THE INVENTION

The present invention relates to engine systems having internal combustion engines in which cylinders are supplyable with fuel via multiple injectors, in particular via an intake manifold injection and a direct injection.

BACKGROUND INFORMATION

In internal combustion engines in which a combined injection system allows both an intake manifold injection and a direct injection, it is necessary to adapt the control of the injectors provided therefor. The adaptation takes place in that the injectors may be controlled in such a way that a fuel quantity predefined by an injection quantity specification is injected. The adaptation usually takes place in an operating state in which the injection takes place either entirely via the intake manifold or entirely as a direct injection. For this purpose, adaptation ranges are predefined, which define the ranges for the operating states of the internal combustion engine, in which an adaptation of an adaptation value is permitted which acts on the fuel quantity to be injected. The ascertained adaptation values are, however, always incorporated in the calculation of the fuel quantity, even if the instantaneous operating state of the internal combustion engine is outside the adaptation range.

Due to component tolerances and aging it is necessary to adapt the adaptation values used for the adaptation on a regular basis or at predefined points in time. According to the above methods, a correction or adaptation of the adaptation value takes place only if the relevant injection takes place either entirely via the intake manifold or entirely as a direct injection. If the adaptation is to be carried out at an arbitrary point in time, the operating state must be adapted so that it lies within the adaptation range. In particular, the operating state is modified in such a way that the internal combustion engine is operated almost entirely in the operating mode for which the adaptation value is to be adapted. This, however, results in that an optimized operating state of the internal combustion engine, which possibly provides a combined use of the direct injection and the intake manifold injection, must be exited. This is disadvantageous in particular for the fuel consumption, the exhaust gas composition, and the operating behavior, as may be expressed by knocking of the internal combustion engine, for example.

SUMMARY

It is thus an object of the present invention to provide an improved method and a device for adapting the control of the injectors in internal combustion engines having a combined intake manifold injection and direct injection, in particular being able to dispense with a complete switchover to one of the injection types for the adaptation of the adaptation value.

According to a first aspect, an example method for adapting the adaptation values for the adaptation of fuel injection quantities of an internal combustion engine is provided to which fuel is supplyable via a mixed operation of two injection types. A first adaptation value is adapted for adapting a first injection quantity specification, according to which the internal combustion engine is operated using a first injection type, and a second adaptation value is adapted for adapting a second injection quantity specification, according to which the internal combustion engine is operated using a second injection type; the adaptation values are each adapted in defined, not overlapping adaptation ranges as a function of the operating state, at least one of the adaptation ranges including operating states in which fuel is supplied to the internal combustion engine via both injection types.

In accordance with the present invention, the adaptation of the adaptation value for controlling the relevant injector in an internal combustion engine having multiple injection types is carried out when an operating state of the internal combustion engine is within a predefined adaptation range. This takes place regardless of whether or not the internal combustion engine is in a mixed operation.

Furthermore, the first injection type may correspond to an intake manifold injection and the second injection type to a direct injection, the adaptation of the first adaptation value being carried out during the operating states in which fuel is supplied to the internal combustion engine via both the intake manifold injection and the direct injection.

According to one specific embodiment, the adaptation of the second adaptation value may be carried out during the operating states in which fuel is supplied to the internal combustion engine via direct injection at more than 60%, 70%, 80%, 90% or 95%.

It may be provided that the adaptation of the particular adaptation value takes place in that an instantaneous adaptation value is ascertained for the relevant injection type, and a previously ascertained adaptation value is adapted for the relevant injection type in that the previous adaptation value is acted on by the ascertained adaptation value, which has been weighted using a weighting factor, for the relevant injection type.

According to another aspect, an example method is provided for adapting a first injection quantity specification and a second injection quantity specification for controlling a fuel injection into an internal combustion engine, to which fuel may be supplied via a mixed operation of two injection types. As a function of an operating point, a distribution ratio is made available, a predefined total fuel quantity, which is to be made available for a combustion in a cylinder of the internal combustion engine, being distributed according to the distribution ratio to ascertain the first injection quantity specification and the second injection quantity specification, the first injection quantity specification and the second injection quantity specification being ascertained as a function of the first and the second adaptation values, respectively, which are adapted by the above method, in particular by addition or multiplication.

Furthermore, an adaptation value offset may be adapted, the adaptation value offset being distributed according to the distribution ratio and being used to ascertain the appropriate injection quantity specification.

According to another specific embodiment, an intake manifold adaptation value offset and a direct injection adaptation value offset may be adapted which act on the appropriate injection quantity specification.

Furthermore, an intake manifold adaptation value offset and a direct injection adaptation value offset may be adapted, each is acted on by the distribution ratio.

According to another aspect, a control unit is provided for adapting the adaptation values for the fuel injection quantities of an internal combustion engine, to which fuel is supplyable via a mixed operation of two injection types, the control unit being designed to adapt a first adaptation value for adapting a first injection quantity specification to operate the internal combustion engine using a first injection type and a second adaptation value for adapting a second injection quantity specification to operate the internal combustion engine using a second injection type, and to adapt each of the adaptation values in defined, not overlapping adaptation ranges as a function of the operating state; at least one of the adaptation ranges includes operating states in which fuel is supplied to the internal combustion engine via both injection types.

According to another aspect, an engine system is provided. The engine system includes:

an internal combustion engine, and the control unit mentioned above.

According to another aspect, a computer program product is provided, which contains a program code which carries out the above-described method when it is executed on a data processing unit.

BRIEF DESCRIPTION OF THE DRAWINGS

Preferred specific embodiments are explained in greater detail below on the basis of the figures.

DETAILED DESCRIPTION OF EXAMPLE EMBODIMENTS

Figure 1:
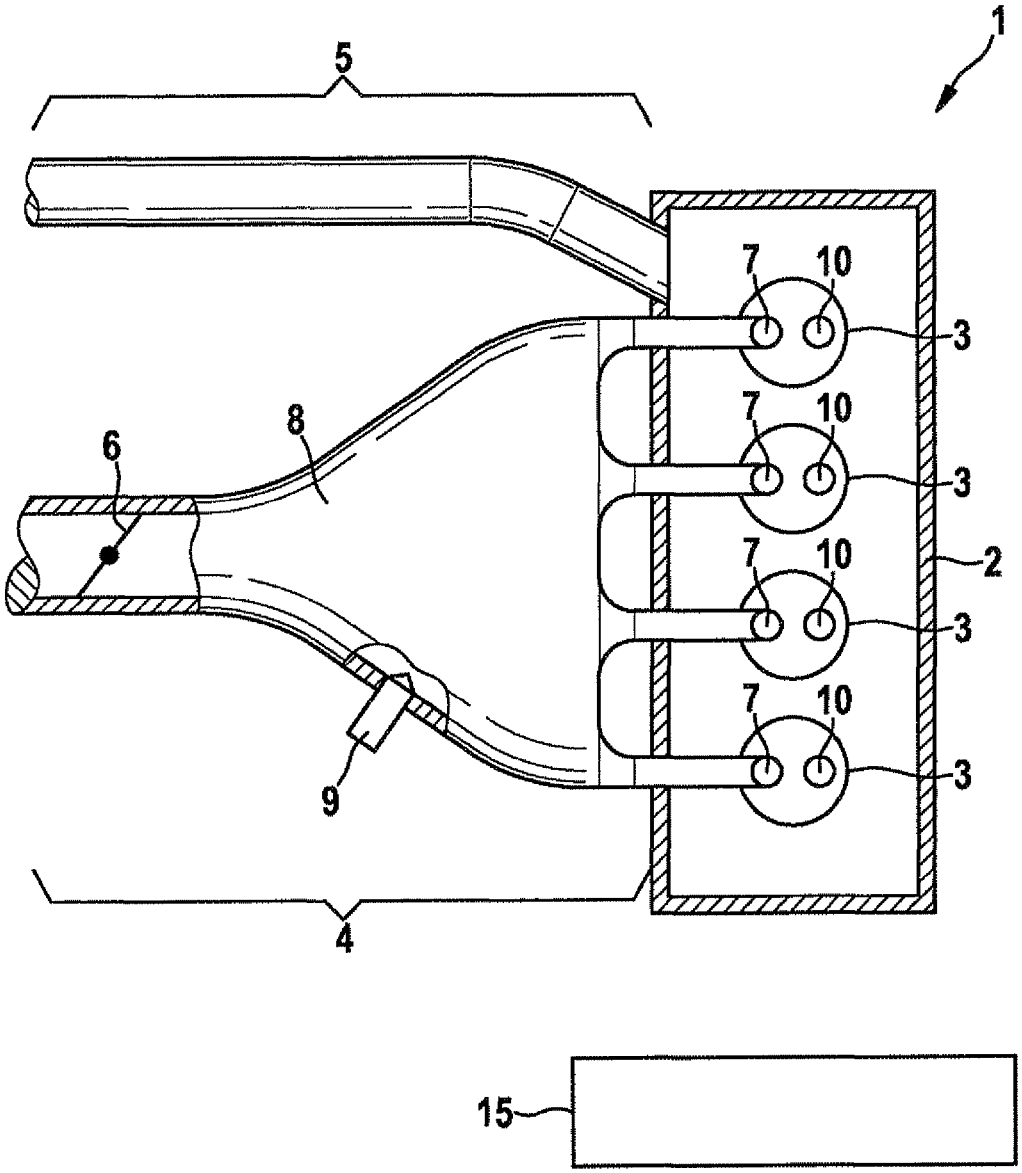
FIG. 1 shows a schematic representation of an engine system having an internal combustion engine which is operatable by two injection types.

FIG. 1 shows an engine system 1 including an internal combustion engine 2 which has four cylinders 3 with their respective combustion chambers. Cylinders 3 are supplied with air via an air supply system 4 controlled by appropriate intake valves 7 at the entrances to the combustion chambers of the cylinders. Combustion exhaust gases are discharged from the combustion chambers of cylinders 3 via appropriate exhaust valves (not shown) and an exhaust gas discharge segment 5.

In air supply system 4, a throttle valve 6 is situated which controls the air flow, i.e., the air quantity, into cylinders 3. In the area of air supply system 4, an intake manifold 8 is provided between throttle valve 6 and intake valves 7 of cylinders 3. In intake manifold 8, an injector 9 is situated to inject fuel via intake manifold injection during the operation of internal combustion engine 2. Furthermore, cylinders 3 are provided with direct injectors 10 to inject fuel directly into cylinders 3. In an alternative specific embodiment, an intake manifold injector may be provided for each of cylinders 3. The intake manifold injectors may each be provided in a particular supply line between intake manifold 8 and corresponding intake valve 7.

Furthermore, engine system 1 includes a control unit 15 which controls injectors 9, 10, the function of intake valves 7 and of the exhaust valves, throttle valve 6, and other actuators of engine system 1 to operate internal combustion engine 2 according to a specification.

Control unit 15 controls the fuel injection via injectors 9, 10 as a function of the operating point of the internal combustion engine, e.g., as a function of engine rotational speed n and/or load M. The control variable of injectors 9, 10 is an injection quantity specification which is converted in the appropriate control unit for injectors 9, 10 into an injection of an appropriate fuel quantity. In particular, the duration of the injection is established by the injection quantity specification.

Figure 2:
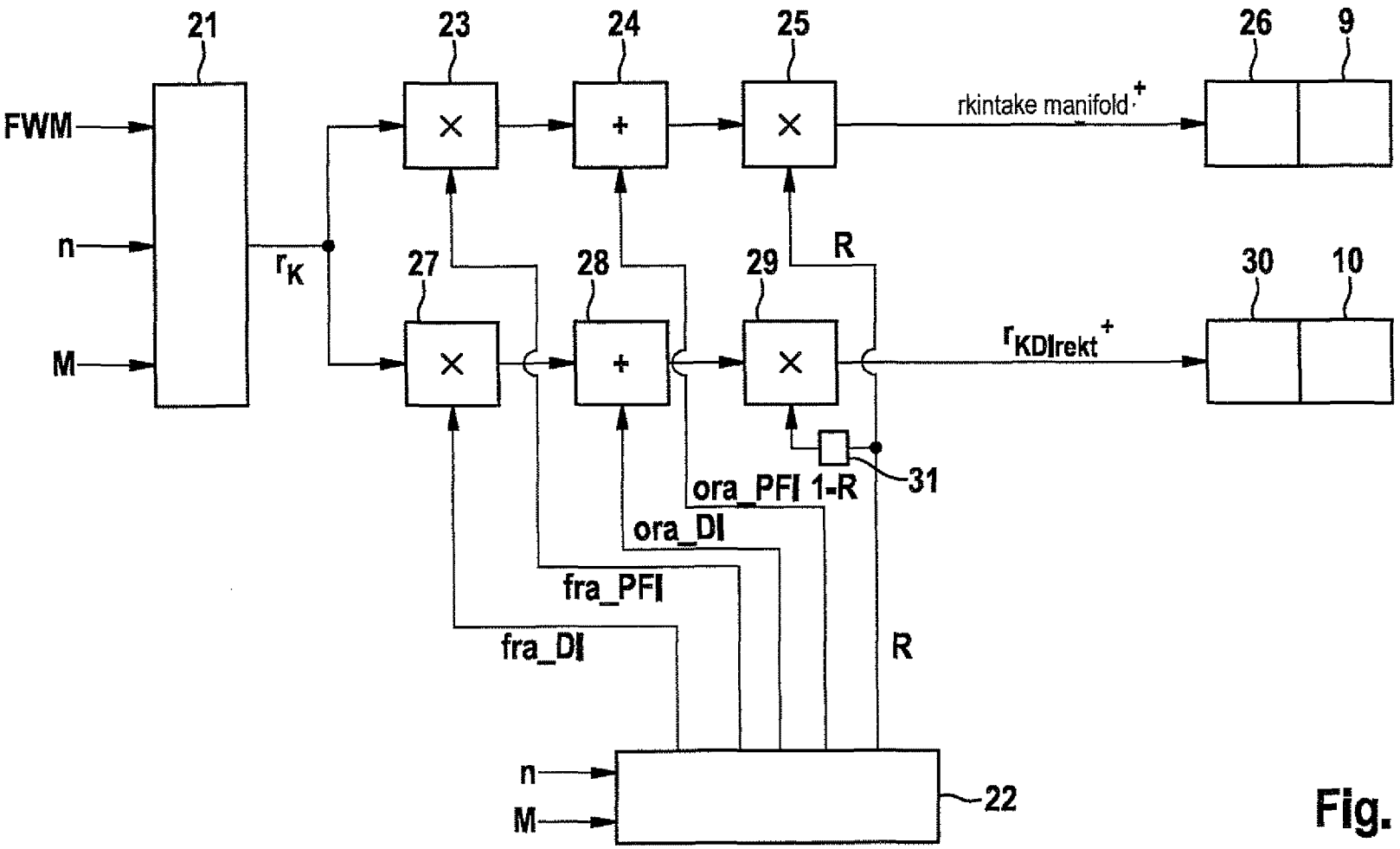
FIG. 2 shows a function diagram to represent the consideration of adaptation values when determining the injection quantity for the individual injection types.

In FIG. 2, a function diagram is schematically represented which illustrates how the injection quantity specification is ascertained. In an injection quantity block 21, a total injection quantity $r_K$ is ascertained as a function of a predefined driver intended torque DIT and an operating point which is specified by engine rotational speed n and engine load M, for example. The total injection quantity corresponds to a specification of the fuel quantity which is to be injected into a cylinder for the combustion to provide a desired torque. Alternatively, a desired air/fuel ratio (lambda) may be provided with the aid of the total injection quantity.

To ascertain an intake manifold injection quantity specification $r_{Kintake\ manifold}$ for the intake manifold injection, total injection quantity $r_K$ is acted on by a predefined intake manifold adaptation value fra_PFI (multiplied in a first multiplication block 23 in the present exemplary embodiment). In a first adding element 24, an intake manifold adaptation value offset ora_PFI is added to the product thus ascertained. Subsequently, the obtained sum is multiplied in a second multiplication block 25 by a distribution ratio R to obtain intake manifold injection quantity specification $r_{Kintake\ manifold}$ which is converted in an intake manifold injector control unit 26 into a suitable control for intake manifold injector 9.

Similarly, to ascertain a direct injection injection quantity specification $r_{Kdirect}$ for the direct injection, total injection quantity $r_K$ is acted on by a predefined direct injection adaptation value fra_DI (multiplied in a third multiplication block 27 in the present exemplary embodiment). In a second adding element 28, a direct injection adaptation value offset ora_DI is added to the product thus ascertained. Direct injection adaptation value ora_DI may be ascertained by another method which is, for example, based on an evaluation of the voltage and the current characteristics in the actuators of direct injectors 10. Such a method is conventional and is not be discussed in further detail here.

Subsequently, the obtained sum is multiplied in a fourth multiplication block 29 by a distribution ratio 1−R to obtain direct injection quantity specification $r_{Kdirect}$ which is converted in a direct injection control unit 30 into a suitable control for direct injector 10.

Intake manifold injector control unit 26 and direct injection control unit 30 may be provided in control unit 15. Intake manifold adaptation value offset ora_PFI, direct injection adaptation value offset ora_DI, intake manifold adaptation value fra_PFI, direct injection adaptation value fra_DI, and distribution ratio R are predefined by an adaptation value block 22 as a function of the operating point of the internal combustion engine, which may be determined by engine rotational speed n and/or engine load M, and/or as a function of a predefined or learned characteristic field or a predefined or learned function.

Distribution ratio R made available by adaptation function block 22 indicates as a function of the operating state, i.e., as a function of the rotational speed and/or the load of the internal combustion engine, how total injection quantity $r_K$ is to be distributed between the individual injection types. For example, an intake manifold injection quantity specification $r_{Kintake\ manifold}$ may be determined in that the adapted total injection quantity, which was acted on by intake manifold adaptation value offset ora_PFI, is multiplied by distribution ratio R, while the adapted total injection quantity, which was acted on by direct injection adaptation value offset ora_DI, is acted on by inverse distribution ratio 1−R in order to obtain direct injection injection quantity specification $r_{Kdirect}$. Inverse distribution ratio 1−R results from the difference between 1 and distribution ratio R, the difference being ascertained in a difference block 31.

To adapt injection quantity specifications $r_{Kintake\ manifold}$, $r_{Kdirect}$ thus obtained, adaptation values fra_PFI (for intake manifold injection quantity $r_{Kintake\ manifold}$) and fra_DI (for direct injection quantity $r_{Kdirect}$) are provided. Adaptation values fra_PFI, fra_DI are made available by adaptation value block 22, possibly as a function of the operating point (rotational speed n, torque M). Direct injection adaptation value offset ora_DI and direct injection adaptation value fra_DI, and intake manifold adaptation value offset ora_PFI and intake manifold adaptation value fra_PFI are stored in adaptation value block 22. Generally, adapted intake manifold injection quantity specification $r_{Kintake\ manifold}$ results from total injection quantity $r_K$ as follows:

$$r_{Kintake\ manifold}=r_K\times R\times \text{fra_PFI}+\text{ora_PFI}\times R$$

Similarly, adapted direct injection quantity $r_{Kdirect}$ results from total injection quantity $r_K$ as follows:

$$r_{Kdirect}=r_K\times(1-R)\times \text{fra_DI}+\text{ora_DI}\times(1-R)$$

The adaptation values are adapted in adaptation block 22 when certain operating points are present. Such an adaptation takes into consideration component tolerances and aging. While until now, it has been provided for this purpose to carry out the adaptation of the adaptation values for the intake manifold injection quantity specification in the case of an almost complete intake manifold injection and the adaptation of the direct injection quantity specification in the case of an almost complete direct injection, the example method provides that the adaptation of the adaptation values will be carried out in adaptation block 22 as soon as an operating state is present which lies within a predefined adaptation range. Here, the operating state may also be associated with a mixed operation in which the internal combustion engine is operated. For example, an adaptation of the intake manifold adaptation value may be carried out when distribution ratio R provides for a considerably higher portion of the intake manifold injection than the portion of the direct injection, as is the case with a distribution ratio R≥70%, ≥80% or ≥90%.

Furthermore, the adaptation of intake manifold adaptation value fra_PFI is only carried out if a sufficient distance from the operating points is present at which an adaptation of direct injection adaptation value offset ora_DI or of intake manifold adaptation value offset ora_PFI may be carried out.

The adaptation values may be ascertained in various ways. In the simplest case, the air/fuel ratio is measured in the form of a lambda value, and the adaptation value is ascertained from the deviation with regard to a predefined setpoint value. Alternatively, during a certain operating state, the injection quantity is increased or reduced, and the resulting reaction is evaluated with regard to the rotational speed of the internal combustion engine. Generally, the adaptation of the adaptation values is carried out so that the adaptation value does not change erratically. Rather, a newly ascertained adaptation value is weighted and used to update the existing adaptation value by addition or multiplication. In this way, the influence of individual extremes of the ascertained adaptation value may be reduced.

Figure 3:
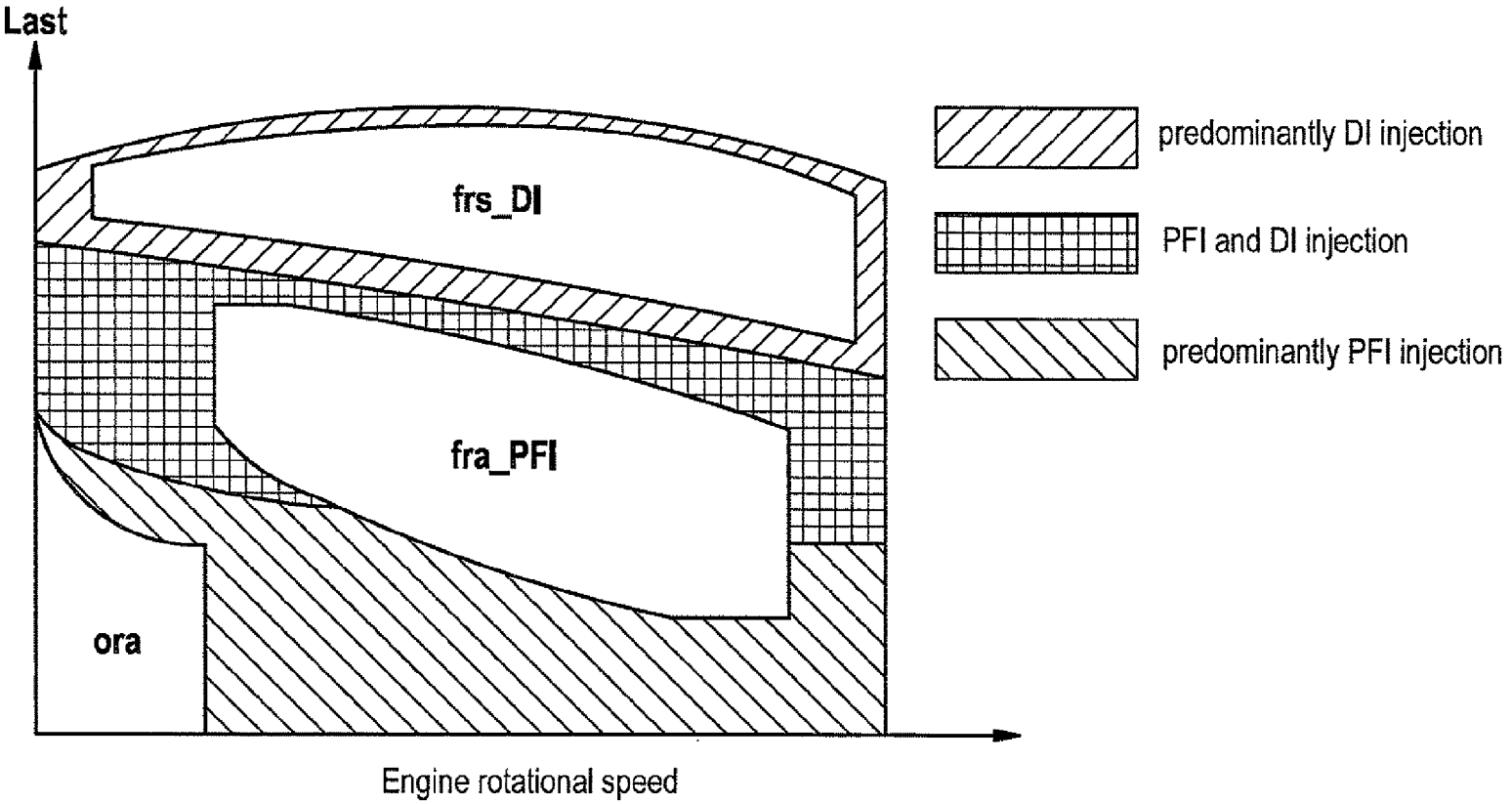
FIG. 3 shows a representation of the adaptation ranges in which an adaptation of the particular adaptation value may be performed for an intake manifold injection and a direct injection.

The adaptation ranges in which the adaptations are performed are, for example, illustrated in FIG. 3, where the particular ranges are marked in white. It is apparent that intake manifold adaptation value fra_PFI is adapted in an adaptation range in which the operating points defining the adaptation range provide a distribution ratio R; at these operating points, both an intake manifold injection and a direct injection take place. Furthermore, it is provided that the adaptation of the direct injection adaptation value takes place in operating ranges in which a direct injection, predefined by distribution ratio R, predominantly occurs.

The adaptation of the adaptation values takes place in such a way that only one adaptation value is adapted at the same time. For this purpose, the adaptation ranges are to be defined in such a way that they do not overlap for adaptation values fra_PFI, fra_DI and adaptation value offsets ora_PFI, ora_DI.

Figure 4:
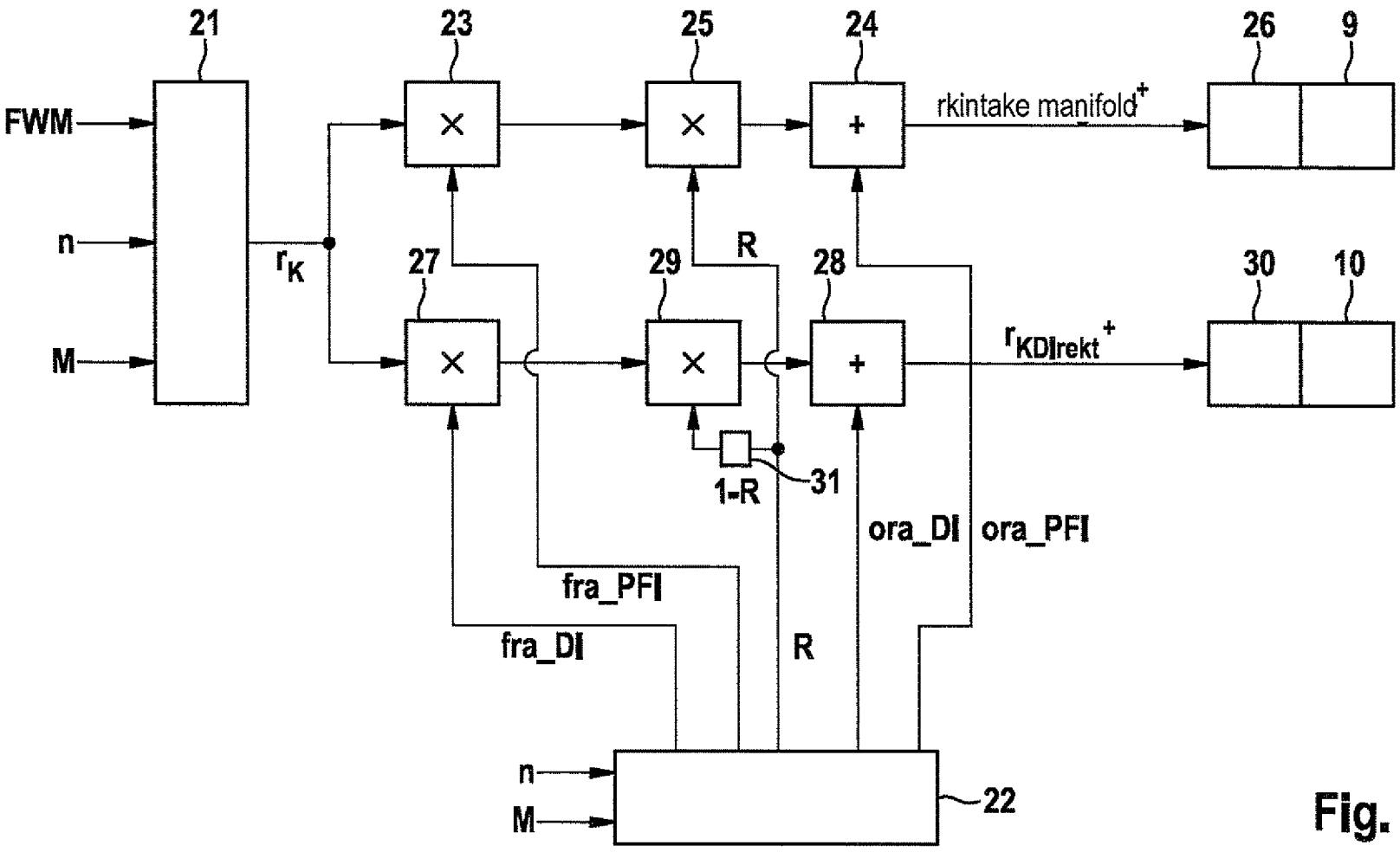
FIG. 4 shows another function diagram to represent the consideration of adaptation values when determining the injection quantity for the individual injection types.

According to an alternative specific embodiment, adaptation value offsets ora_DI, ora_PFI to intake manifold injection quantity $r_{Kintake\ manifold}$ and direct injection quantity $r_{Kdirect}$ may be considered after the multiplication by the appropriate distribution ratios, as shown in the function diagram of FIG. 4. It is apparent that the arrangements of blocks 25, 24 and 28, 29 are generally swapped for this purpose.

What is claimed is:

1. A method for adapting adaptation values for adaptation of fuel injection quantities of an internal combustion engine to which fuel is supplyable via a mixed operation of two injection types, the first injection type corresponding to an intake manifold injection and the second injection type corresponding to a direct injection, the method comprising:

when an operating state of the internal combustion engine is within a first predefined range, setting a first adaptation value;

when the operating state of the internal combustion engine is within a second predefined range that does not overlap with the first range, setting a second adaptation value;

adapting (a) a first injection quantity specification according to which to operate the internal combustion engine by a first injection type, wherein the adaptation of the first injection quantity specification is performed using the first adaptation value and not using the second adaptation value, and (b) a second injection quantity specification according to which to operate the internal combustion engine by a second injection type, wherein the adaptation of the second injection quantity specification is performed using the second adaptation value and not using the first adaptation value; and controlling the internal combustion engine to operate at a same time with:

(a) the first injection type according to the first injection quantity specification that was adapted using the first adaptation value and not the second adaptation value; and (b) the second injection type according to the second injection quantity specification that was adapted using the second adaptation value and not the first adaptation value;

wherein at least one of the first and second predefined ranges includes operating states in which fuel is supplied to the internal combustion engine via both the first injection type and the second injection type.

2. The method as recited in claim 1, wherein the first injection type corresponds to the intake manifold injection and the second injection type corresponds to the direct injection, and wherein the adapting of the first adaptation value is carried out during the operating states in which fuel is supplied to the internal combustion engine via both the intake manifold injection and the direct injection.

3. The method as recited in claim 2, wherein the adapting of the second adaptation value is carried out during the operating states in which fuel is supplied to the internal combustion engine via direct injection at more than one of 70%, 80%, 90% or 95%.

4. The method as recited in claim 1, wherein the adapting of each of the first adaptation value and the second adaptation value takes place in that an instantaneous adaptation value is ascertained for the first injection type and the second injection type, respectively, and a previously ascertained adaptation value is adapted for the respective injection type in that the previous adaptation value is acted on by the ascertained adaptation value, which is weighted using a weighting factor, for the respective injection type.

5. A method for adapting a first injection quantity specification for a first portion of a predefined total fuel quantity to be made available by a fuel injection for a combustion in a cylinder of an internal combustion engine and for adapting a second injection quantity specification for a second portion of the predefined total fuel quantity to be made available by the fuel injection, wherein (a) the first portion is provided by a first injection type and the second portion is provided by a second injection type so that the fuel is supplied via a mixed operation of the first and second injection types, (b) a distribution ratio, according to which the predefined total fuel quantity is distributed between the first and second injection types, is made available as a function of an operating point, and (c) the first injection quantity specification and the second injection quantity specification are ascertained as a function of first and second adaptation values, respectively, the method comprising:

when an operating state of the internal combustion engine is within a first predefined range, setting the first adaptation value;

when the operating state of the internal combustion engine is within a second predefined range that does not overlap with the first range, setting the second adaptation value;

adapting (a) the first injection quantity specification according to which to operate the internal combustion engine by the first injection type, wherein the adaptation of the first injection quantity specification is performed using the first adaptation value and not using the second adaptation value, and (b) the second injection quantity specification according to which to operate the internal combustion engine by the second injection type, wherein the adaptation of the second injection quantity specification is performed using the second adaptation value and not using the first adaptation value; and controlling the internal combustion engine to operate at a same time with:

(a) the first injection type according to the first injection quantity specification that was adapted using the first adaptation value and not the second adaptation value; and (b) the second injection type according to the second injection quantity specification that was adapted using the second adaptation value and not the first adaptation value;

wherein at least one of the first and second predefined ranges includes operating states in which fuel is supplied to the internal combustion engine via both the first injection type and the second injection type.

6. The method as recited in claim 5, wherein an adaptation value offset is adapted, the adaptation value offset being distributed according to the distribution ratio and used to ascertain the corresponding injection quantity specification.

7. The method as recited in claim 5, wherein an intake manifold adaptation value offset and a direct injection adaptation value offset are adapted which act on the appropriate injection quantity specification.

8. The method as recited in claim 7, wherein an intake manifold adaptation value offset and a direct injection adaptation value offset are adapted, each of which is acted on by the distribution ratio.

9. A control unit for adapting adaptation values for adaptation of fuel injection quantities of an internal combustion engine to which fuel is supplyable via a mixed operation of two injection types, the control unit comprising:

processing circuitry configured to:

when an operating state of the internal combustion engine is within a first predefined range, set a first adaptation value;

when the operating state of the internal combustion engine is within a second predefined range that does not overlap with the first range, set a second adaptation value;

adapt (a) a first injection quantity specification according to which to operate the internal combustion engine by a first injection type, wherein the adaptation of the first injection quantity specification is performed using the first adaptation value and not using the second adaptation value, and (b) a second injection quantity specification according to which to operate the internal combustion engine by a second injection type, wherein the adaptation of the second injection quantity specification is performed using the second adaptation value and not using the first adaptation value; and control the internal combustion engine to operate at a same time with:

(a) the first injection type according to the first injection quantity specification that was adapted using the first adaptation value and not the second adaptation value; and (b) the second injection type according to the second injection quantity specification that was adapted using the second adaptation value and not the first adaptation value;

wherein at least one of the first and second predefined ranges includes operating states in which fuel is supplied to the internal combustion engine via both injection types.

10. An engine system, comprising:

an internal combustion engine; and a control unit for adapting adaptation values for adaptation of fuel injection quantities of the internal combustion engine to which fuel is supplyable via a mixed operation of two injection types, wherein:

the control unit includes processing circuitry configured to:

when an operating state of the internal combustion engine is within a first predefined range, set a first adaptation value;

when the operating state of the internal combustion engine is within a second predefined range that does not overlap with the first range, set a second adaptation value;

adapt (a) a first injection quantity specification according to which to operate the internal combustion engine by a first injection type, wherein the adaptation of the first injection quantity specification is performed using the first adaptation value and not using the second adaptation value, and (b) a second injection quantity specification according to which to operate the internal combustion engine by a second injection type, wherein the adaptation of the second injection quantity specification is performed using the second adaptation value and not using the first adaptation value; and control the internal combustion engine to operate at a same time with:

(a) the first injection type according to the first injection quantity specification that was adapted using the first adaptation value and not the second adaptation value; and (b) the second injection type according to the second injection quantity specification that was adapted using the second adaptation value and not the first adaptation value; and at least one of the first and second predefined ranges includes operating states in which fuel is supplied to the internal combustion engine via both injection types.

11. A non-transitory computer readable medium containing a program code for adapting adaptation values for adaptation of fuel injection quantities of an internal combustion engine to which fuel is supplyable via a mixed operation of two injection types, the first injection type corresponding to an intake manifold injection and the second injection type corresponding to a direct injection, the program code, when executed by a processor, causing the processor to perform the steps of:

when an operating state of the internal combustion engine is within a first predefined range, setting a first adaptation value;

when the operating state of the internal combustion engine is within a second predefined range that does not overlap with the first range, setting a second adaptation value;

adapting (a) a first injection quantity specification according to which to operate the internal combustion engine by a first injection type, wherein the adaptation of the first injection quantity specification is performed using the first adaptation value and not using the second adaptation value, and (b) a second injection quantity specification according to which to operate the internal combustion engine by a second injection type, wherein the adaptation of the second injection quantity specification is performed using the second adaptation value and not using the first adaptation value; and controlling the internal combustion engine to operate at a same time with:

(a) the first injection type according to the first injection quantity specification that was adapted using the first adaptation value and not the second adaptation value; and (b) the second injection type according to the second injection quantity specification that was adapted using the second adaptation value and not the first adaptation value;

wherein at least one of the first and second predefined ranges includes operating states in which fuel is supplied to the internal combustion engine via both the first injection type and the second injection type.

12. A method comprising:

during a first operating state of an internal combustion engine, determining, by processing circuitry, a first value;

during a second operating state of the internal combustion engine, determining, by the processing circuitry, a second value;

subsequently:

setting, by the processing circuitry and based on the first value and not the second value, a quantity of fuel to be injected into the internal combustion engine by direct fuel injection during a third operating state of the internal combustion engine; and setting, by the processing circuitry and based on the second value and not the first value, a quantity of fuel to be injected into the internal combustion engine by manifold fuel injection during the third operating state of the internal combustion engine.

13. The method of claim 12, wherein the quantities of fuel to be injected by the direct and manifold injections are determined by the processing circuitry by:

determining, based on the third operating state, a total fuel quantity to be injected into the internal combustion engine; and using the determined total fuel quantity for application of (a) a ratio of direct injection to manifold injection and (b) the first and second values.

14. The method of claim 13, wherein the application of the ratio includes multiplications and the application of the first and second values includes multiplications.

15. The method of claim 13, wherein the application of the ratio includes multiplications and the application of the first and second values includes additions, the first and second values being offsets.

16. The method of claim 12, wherein the quantities of fuel to be injected by the direct and manifold injections are determined by the processing circuitry by:

determining, based on the third operating state, a total fuel quantity to be injected into the internal combustion engine;

modifying the determined total fuel quantity using the first value to obtain the quantity of fuel to be injected into the internal combustion engine by the direct fuel injection; and modifying the determined total fuel quantity using the second value to obtain the quantity of fuel to be injected into the internal combustion engine by the manifold fuel injection.

17. The method of claim 16, wherein fuel is supplied to the internal combustion engine by both direct fuel injection and manifold fuel injection during at least one of the first and second operating states.

18. The method of claim 12, wherein fuel is supplied to the internal combustion engine by both direct fuel injection and manifold fuel injection during at least one of the first and second operating states.

19. The method of claim 13, wherein fuel is supplied to the internal combustion engine by both direct fuel injection and manifold fuel injection during at least one of the first and second operating states.

20. The method of claim 14, wherein fuel is supplied to the internal combustion engine by both direct fuel injection and manifold fuel injection during at least one of the first and second operating states.

21. The method of claim 15, wherein fuel is supplied to the internal combustion engine by both direct fuel injection and manifold fuel injection during at least one of the first and second operating states.

* * * * *